US005779102A

United States Patent [19]

Smith

[11] Patent Number: 5,779,102

[45] Date of Patent: Jul. 14, 1998

[54] DUAL COMPARTMENT BEVERAGE DISPENSER

[76] Inventor: Dennis Smith, 505 S. Beverly Dr., Suite 106, Beverly Hills, Calif. 90212

[21] Appl. No.: 799,583

[22] Filed: Feb. 12, 1997

[51] Int. Cl.[6] ..... A47G 19/12

[52] U.S. Cl. ..... 222/144.5; 222/473; 222/475.1; 222/484

[58] Field of Search ..... 222/129, 144.5, 222/472, 473, 475.1, 484

[56] References Cited

U.S. PATENT DOCUMENTS

| | | | |
|---|---|---|---|
| 872,536 | 12/1907 | Nystrom | 222/472 |
| 1,025,653 | 5/1912 | Sims | 222/144.5 |
| 1,569,445 | 1/1926 | Workman | 222/144.5 |
| 2,249,918 | 7/1941 | Sprout | 222/472 X |
| 2,272,867 | 2/1942 | Cobel | 222/473 |
| 2,681,745 | 6/1954 | Sung et al. | 222/144.5 |
| 3,400,865 | 9/1968 | Hester | 222/475.1 X |
| 4,651,900 | 3/1987 | Horvath | 222/144.5 |
| 4,703,871 | 11/1987 | Broker | 222/144.5 |
| 4,750,644 | 6/1988 | Kolody | 222/144.5 |
| 4,773,563 | 9/1988 | Taylor | 222/144.5 |
| 4,802,406 | 2/1989 | Bouldin | 222/475.1 X |
| 5,072,858 | 12/1991 | Brashier | 222/144.5 |
| 5,265,767 | 11/1993 | Gustafson | 222/144.5 |
| 5,335,589 | 8/1994 | Yerves, Jr. et al. | 222/144.5 X |
| 5,615,808 | 4/1997 | Huang | 222/472 |

*Primary Examiner*—Kevin P. Shaver

*Attorney, Agent, or Firm*—David & Raymond; Raymond Y. Chan

[57] ABSTRACT

A beverage dispenser includes a beverage container assembly combined by two single chamber containers, in which each single chamber container has an internal chamber and a predetermined access opening on a top, whereby the access openings are concealed and enclosed by a top closure cap assembly. The top closure cap assembly provides each single chamber container with a spout opening and at least one air holes. The top closure cap assembly further installed with at least one air tight shut off device for selectively shutting off at least one spout opening and one air hole. Whereby the improved beverage dispenser has relatively simple and low cost structure for enabling the user to selectively serve two kinds of beverage received within the two single chamber containers respectively at a time by a single hand operation for bringing great conveniences for standard households or businesses.

18 Claims, 5 Drawing Sheets

DUAL COMPARTMENT BEVERAGE DISPENSER

FIELD OF THE PRESENT INVENTION

The present invention relates to a beverage dispenser, and more particularly to a hot or cold coffee pot which is capable of selectively serving two kinds of beverage, such as coffee and tea, or regular coffee and decaffeinated coffee, at one time by a single hand operation for definitely bringing great convenience for standard households or businesses.

BACKGROUND OF THE PRESENT INVENTION

In our society today, there are countless number of businesses which require serving of beverages to customers, and yet the number is still climbing at a tremendous rate. Various beverages are served daily from a common hamburger stand to a business flight. Today, more and more people are in addiction with caffeine hidden within our cups of coffee every morning. People of the ninety's just seem to have too many opinions on what they specifically demand in their cups, yes freedom of choice, but seriously we are giving inconveniences to waiters or waitresses who's serving us daily.

To be in the eye of the holder, discovering how hard it is to serve people as an waiter or waitress, knowing that many jobs in our society today require our hands during work. Imagine you being a waiter, instead of occupying both of your hands when you're serving regular or decaffeinated coffee, you can use the other free hand to pick up things or to prevent an accident coming your way, or sometime even to write. Especially on an airplane, working during flights, everyone knows the importance of our hands being free to keep our body stable and balance in an airplane.

Prior in our market, there are a plurality of beverage dispensers being manufactured and produced. But the prior products didn't really make in our market today, due to the consumers discovering the unsatisfactory points in regard to these prior products. Some of the prior arts have bottle leaking problem while some of the prior arts have too complicated, costly and uncomfortable design. For example, U.S. Pat. Nos. 2,681,745, 4,651,900, 4,703,871, 4,750,644, 4,773,563, and 5,072,858 disclose the major prior arts of dual beverage dispenser.

The pressure responsive multipurpose pot as shown in U.S. Pat. No. 2,681,745 discloses a cover for the upper opening upon the pot body having a pair of depending block portions adapted to extend down into the two chambers of the pot body with a flat bottomed groove between said block portions having the outer ends thereof widened in substantially triangular form within the flange of the cover to only allow partial rotation of the cover on the pot body. It is an old fashion design is that unable to apply to the modern coffee pot.

U.S. Pat. No. 4,651,900 discloses a lid member which is pivotally connected to one of the pot halves and movable between first and second positions to selectively close one of the openings and open the other of the openings. However, the swinging lid member requires a complicated operation device to control its position, which includes a spring disposed within spring housing and biases lib to an upright position, so that the server's thumb or finger must always apply a pressure to a tab to overcome the biasing force of the spring and allow the server to selectively cover one of the pot halves. Such structure renders the operation of the pot difficult. It is a very tired task for the server to maintain a pressing force to the tab, otherwise both kinds of liquid within the two compartments may pour out simultaneously.

In U.S. Pat. No. 4,703,871, Broker discloses a valve assembly including first and second valve elements rotatably mounted in the neck for swinging between open and blocking relationship with the compartments and a valve seat in snap-fit relationship with the valve assembly. The valve elements swing downwardly for alternate abutment with the impermeable barrier and into sealing engagement with the valve seat. An actuator is coupled to the valve elements through a shaft and is positioned for actuation by the thumb of a user. Again, Broker's patent requires the user to keep pressing on the valve actuator to ensure that one of the compartments is closed by one of the swinging valve elements while dispensing liquid from the other of the compartments, otherwise both kinds of liquid may be poured out from the two compartments. Both the upward and downward swinging type valve elements of U.S. Pat Nos. 4,651,900 and 4,703,871 have leaking problem if the user fails to apply a firm and sufficient pressing force to the tab or actuator.

Kolody's patent, U.S. Pat No. 4,750,644, suffers a shortcoming that the dispensed liquid must be manually selected by pushing on a corresponding trigger or stud of a unitary lid-handle-valve and valve actuator assembly. This valve actuator assembly is too complicated in structure that the cost of such dual beverage dispenser is relatively too expensive in compare with the acceptable cheap market price for coffee pot. Another essential drawback of the Kolody's patent is that the cylindrically shaped container is secured by screwing to the threaded projection of the lid-handle unit. Therefore, when the lid-handle unit is unscrewed from the outer pot for cleaning and liquid refilling purposes, the cylindrically shaped container is still firmly attached to the lid-handle unit. The user is unable to wash or refill the liquid of the cylindrically shaped container unless the user further unscrews the cylindrically shaped container from the lid-handle unit. However, when hot coffee is refilled into the cylindrically shaped container, the hot cylindrically shaped container is difficult to handle and re-screw to the lid-handle unit.

The coffee dispensing apparatus disclosed in Taylor' U.S. Pat. No. 4,773,563 provides a spout broken into an independent first spout opening and an independent second spout opening by a separate wall for dispensing the liquid within the first container or the second container through the first and second access openings respectively. The separate wall of the spout may obstacle the motion of the valve member. Moreover, since the first and second spout openings are positioned aside of the spout, it renders the difficult of dispensing the liquid in either one of the containers precisely into a coffee cup without spilling. Besides, in order to hingedly mount the valve member within the valve housing but preventing leakage problem, the Taylor's patent has to provide a planar wall member located between the inner walls of the first and second containers, wherein a hinged pin of the valve member is extended within the chamber to fit within the hole located in the valve housing and above the planar wall member. Such configuration complicates the band and spout structure that increases the cost of the coffee dispensing apparatus.

Since the hinged pin is positioned within the valve housing, the thumb contact section of the valve member, which is horizontally extended from the valve member exteriorly of the chamber, must be positioned as closed to the spout as possible to ensure good closing ability of the valve member, so that the handle of Taylor's patent may not be constructed as the usual L-shaped and must only be directly extended from the flange in arc shaped, so that the user's holding hand has the hazard of being hurt by the hot containers.

The U.S. Pat. No. 5,072,858 also requires a complicated chamber selection mechanism installed in the cap assembly house for alternately selecting one or the other of the chambers from which to dispense a beverage. The chamber selection mechanism is costly that it comprises a trigger housed in the handle which actuates a rack and pinion assembly housed in the closure cap. A pinion rod and chamber plug carrier arm mounted thereon rotate as the pinion gear is engaged by the rack. A chamber plug carried by the arm is rotated as desired into position for alternately opening up or shutting off one of the two chambers. The sealing off one of the two chambers and the permitting the other chamber to communicate with the common spout depends on a compression spring for operating to move the chamber selection mechanism to a default position. When the trigger is depressed, the spring is loaded, at the same time opening up the one chamber and shutting off the other. When the trigger is released, the loaded spring moves to its relaxed state and returns the chamber selection mechanism to the default position. There are too many parts and assembling work which may highly increase the manufacturing cost of the Brashier's patent.

Coffee pot is a low price product in the market. It is unacceptable for all the consumers to pay a lot more for an expensive coffee pot with complex structure. Therefore, a dual compartment coffee pot which has the properties of simple structure, easy manufacture and low cost is a long felt need in the market.

SUMMARY OF THE PRESENT INVENTION

The main object of the present invention is to provide an improved dual compartment beverage dispenser having relatively simple and low cost structure for enabling the user to selectively serve two kinds of beverage, such as coffee and tea, or regular coffee and decaffeinated coffee, at one time by a single hand operation for bringing great conveniences for standard households or businesses.

Another object of the present invention is to provide a dual compartment beverage dispenser, in which two kinds of beverage can be selectively served by a single beverage dispenser, so that a waiter or a waitress is capable of serving totally up to four kinds of beverage with both hands.

Another object of the present invention is to provide a dual compartment beverage dispenser which enables the beverage to be easily poured out from any one of the single chamber containers through a single spout while the other chamber container is sealedly shutting off.

Accordingly, a dual compartment beverage dispenser of the present comprises a beverage container assembly, a top closure cap assembly and a shut off device.

The beverage container assembly comprises a first single chamber container having a first internal chamber, and a second single chamber container having a second internal chamber. The first and second single chamber containers are combined to form the beverage container assembly which has a top securing neck having a first and a second access opening for the first and second internal chambers respectively.

The top closure cap assembly is secured to the top securing neck of the beverage container assembly in air tight manner to seal off the first and second single chamber containers. The top closure cap assembly comprises a U-shaped bottom cover having an inner threaded portion for screwing with an outer threaded portion of the top securing neck, so as to connect the top closure cap assembly with the beverage container assembly, a conical top spout having a periphery lip wall upwardly and inclinedly extended from the bottom cover, and a horizontal cover wall integrally formed between the bottom cover and the top spout for covering the first and second access openings of the first and second internal chambers of the first and second single chamber containers respectively, so as to provide an air tight concealing between the first single chamber container, the second single chamber container and the top closure cap assembly. The cover wall has a first and a second spout opening and a first and a second air hole. The first spout opening and the first air hole are respectively formed in a front and a rear position of a first half of the positioned cover wall above the first access opening of the first single chamber container, and that the second spout opening and the second air hole are respectively formed in a front and a rear position of a second half of the positioned cover wall above the second access opening of the second single chamber container. Moreover, the top closure cap assembly further comprises a L-shaped handle which is composed of a handle support bar integrally extended upwardly and inclinedly from an edge of the bottom cover and a grip handle integrally extended downwardly and perpendicularly from the handle support bar.

The built-in shut off device comprises a switching arm having a horizontal front cap arm portion and an inclined rear operating arm portion extended rearwardly from the front cap arm portion. The top spout provides an operation slot which has a width larger than a width of the switching arm and is provided on the lip wall at an intersection position of the lip wall with the handle support bar. The cap arm portion is extended through the operation slot to locate on the cover wall while the operating arm portion is extended along the handle support bar. The switching arm is incorporated with the top closure cap assembly by pivotally connecting the operating arm portion with the handle support bar of the handle by means of an axle pin, so that the cap arm portion is able to be actuated to move between a first position and a second position on the cover wall by switching the operating arm portion to left and right respectively. An enlarged shutting head is provided at a front end of the cap arm portion, wherein the shutting head which has a size slightly larger than the spout openings is adapted to be positioned between the first position and the second position for alternatively overlapping and shutting off the first spout opening and the first air hole or the second spout opening and the second air hole respectively.

In another embodiment of the present invention, the dual compartment beverage dispenser also comprises a beverage container assembly, a top closure cap assembly and a build-in shut off device.

The beverage container assembly comprises a first single chamber container having a first internal chamber and a second single chamber container having a second internal chamber. The first and second single chamber containers are combined to form the beverage container assembly which has a top securing neck having a first and a second access opening for the first and second internal chambers respectively.

The top closure cap assembly is secured to the top securing neck of the beverage container assembly in air tight manner to seal off the first and second single chamber containers. The top closure cap assembly comprises a U-shaped bottom cover having an inner threaded portion for secrewing with an outer threaded portion of the top securing neck so as to connect the top closure cap assembly with the beverage container assembly, a conical top spout having a periphery lip wall upwardly and inclinedly extended from the bottom cover, and a horizontal cover wall integrally formed between the bottom cover and the top spout for covering the first and second access openings of the first and second internal chambers of the first and second single chamber containers respectively, so as to provide an air tight concealing between the first single chamber container, the second single chamber container and the top closure cap assembly. The cover wall has a first and a second spout opening and a first and a second air hole. The first spout opening and the first air hole are respectively formed in a front and a rear position of a first half of the cover wall positioned above the first access opening of the first single chamber container. The second spout opening and the second air hole are respectively formed in a front and a rear position of a second half of the cover wall positioned above the second access opening of the second single chamber container. Moreover, the top closure cap assembly further comprises a handle.

The shut off device comprises a first and a second sliding arms, in which the sliding arms are mobilized to slide back. Each of the first and second sliding arms has a front cap arm portion positioned on the cover wall and a rear operating arm portion extending through an operation slot, which is provided on the top closure cap assembly, to the handle for connecting with a thumb pressing element which is supported by a revolving joint mounted on the handle. A first and a second pair of guider protrusions are provided on the cover wall for holding the first and second sliding arms in position respectively and for guiding a sliding motion of each of the first and second sliding arms respectively. The sliding motion of each of the first and second sliding arms is actuated by a downward pressing force applied to the respective thumb pressing element.

DETAILED DESCRIPTION OF THE PREFERRED EMBODIMENT

Figure 1:
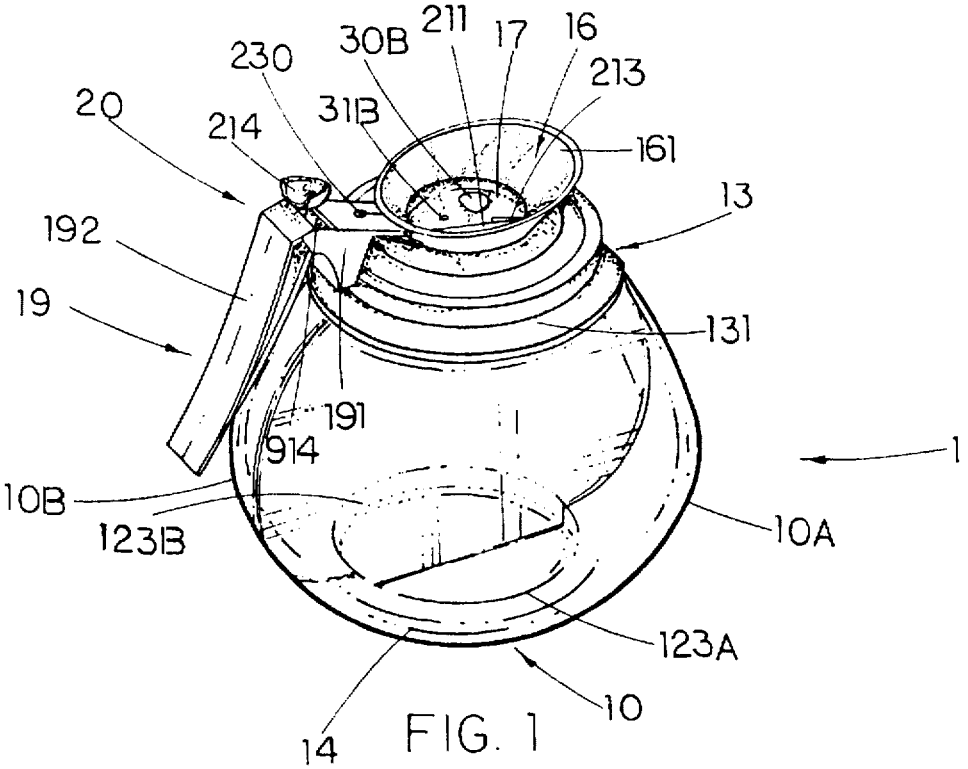
FIG. 1 is a perspective view of a dual compartment beverage dispenser according to a first preferred embodiment of the present invention.

Referring to FIGS. 1 to 4 of the drawings, a first preferred embodiment of a dual compartment beverage dispenser 1 of the present invention is illustrated. The dual compartment beverage dispenser 1 comprises a glass or plastic made beverage container assembly 10 which comprises two identical single chamber containers 10A and 10B, a top closure cap assembly 13 which is screwed to a top securing neck 122 of the beverage container assembly 10 in an air tight manner to seal off the beverage container assembly 10, and a metal made base closure cap 14 firmly secured to a base portion 123 which is constituted by two semi base portions 123A and 123B of the two single chamber containers 10A and 10A of the beverage container assembly 10 for providing a secure holding of the two single chamber containers 10A and 10B together to form the spherically shaped beverage container assembly 10 (as shown in FIG. 3A). The base closure cap 14 can provide a better heat conduction and prevent the heat source to directly apply heat to the base portion 123 of the beverage container assembly 10 that may cause overheating to the base portion 123.

Figure 2:
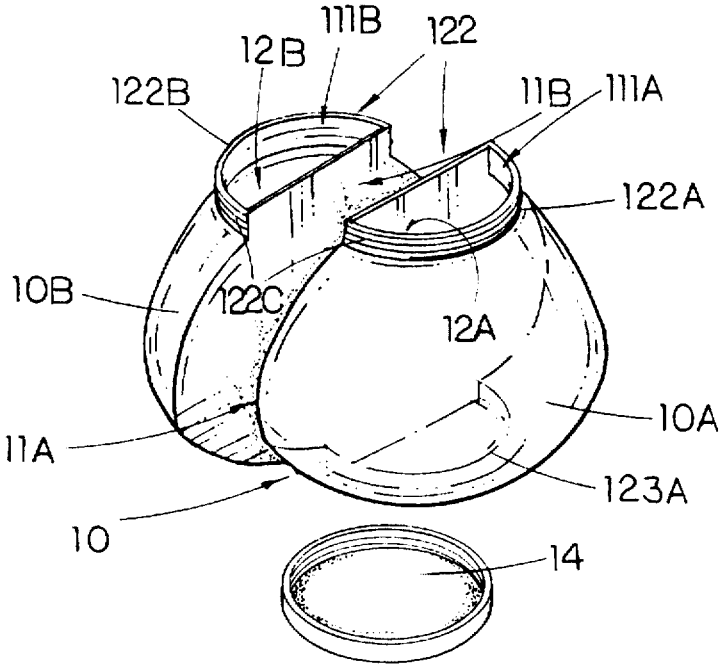
FIG. 2 is an exploded perspective view of a dual compartment beverage container assembly of the beverage dispenser according to the above first preferred embodiment of the present invention.

As shown in FIG. 2, the beverage container assembly 10 is a divided container, in which the beverage container assembly 10 is constructed by the first and second individual single chamber containers 10A and 10B to form two even halves. Each of the first single chamber container 10A and the second single chamber container 10B has a semi-circular cross section and a concealed internal chamber 12A, 12B for providing two storage cavities for any two kinds of liquid beverage, such as coffee and tea or regular coffee and decaffeinated coffee. On top of each of the first and second single chamber containers 10A and 10B provides a top neck portion 122A and 122B and an access opening 111A, 111B. At a back side of each the single chamber container 10A, 10B has a planar back wall 11A, 11B which is compatible between each other. Therefore, when the two single chamber containers 10A and 10B collide at their back walls 11A and 11B, the spherical beverage container assembly 10 is formed, in which the two top neck portions 122A and 122B are combined to form the top securing neck 122 for securing with the top closure cap assembly 13.

As shown in FIGS. 1, 3A, 3B, and 4, the top closure cap assembly 13 comprises a U-shaped bottom cover 131 having an inner threaded portion 131A for secrewing with an outer threaded portion 122C of the top securing neck 122 so as to secure the top closure cap assembly 13 with the beverage container assembly 10. The top closure cap assembly 13 further comprises a conical top spout 16 having a periphery lip wall 161 upwardly and inclinedly extended from the bottom cover 131, and a horizontal cover wall 17 integrally formed between the bottom cover 13 and the top spout 16 for covering both the access openings 111A and 111B of the first and second internal chambers 12A and 12B of the first and second single chamber containers 10A and 10B respectively, so as to provide an air tight concealing between the first single chamber container 10A, the second single chamber container 10B and the top closure cap assembly 13.

The cover wall 17 has a first and a second spout opening 30A, 30B and a first and a second air hole 31A, 31B, wherein the first spout opening 30A and the first air hole 31A are respectively formed in a front and a rear positions of a first half of the cover wall 17 positioned above the first access opening 111A of the first single chamber container 10A. The second spout opening 30B and the second air hole 31B are respectively formed in a front and a rear positions of a second half of the cover wall 17 positioned above the second access opening 111B of the second single chamber container 10B. Therefore, the beverages contained within the first and second internal chambers 12A and 12B can be selectively poured out through the first and second spout openings 30A and 30B. The distance between the first spout opening 30A and the second air hole 31A is equal to the distance between the second spout opening 30B and the second air hole 31B. The presence of the first and second air holes 31A and 31B is very important for enabling the air in atmosphere flowing therethrough into the first and second internal chambers 12A and 12B respectively while consuming the beverage therein. Without the air holes 31A and 31B, the flowing out of the beverage through the spout opening 30A or 30B would find difficulty.

Figure 3A:
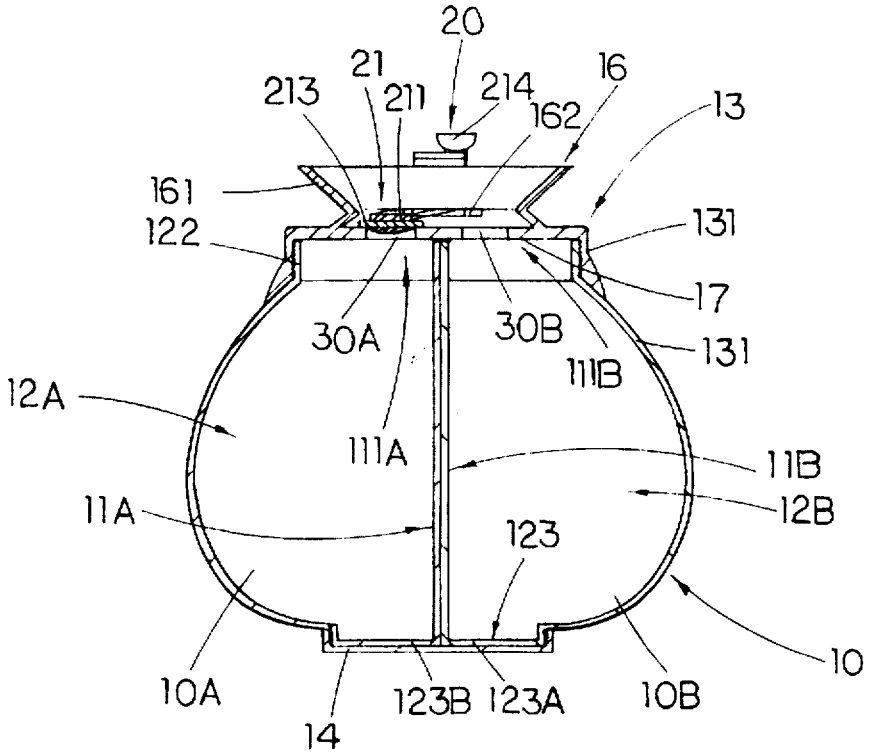
FIG. 3A is a sectional front view of the dual compartment beverage dispenser according to the above first preferred embodiment of the present invention.

As shown in FIGS. 1, 2 and 3A, the top closure cap assembly 13 further comprises a L-shaped handle 19 which is composed of a handle support bar 191 integrally extended upwardly and inclinedly from an edge of the bottom cover 131 thereof and a grip handle 192 integrally extended downwardly and perpendicularly from the handle support bar 191 for hand gripping by the user, in which the thumb of the user is able to reach and rest on the top surface of the handle support bar 191.

Figure 3B:
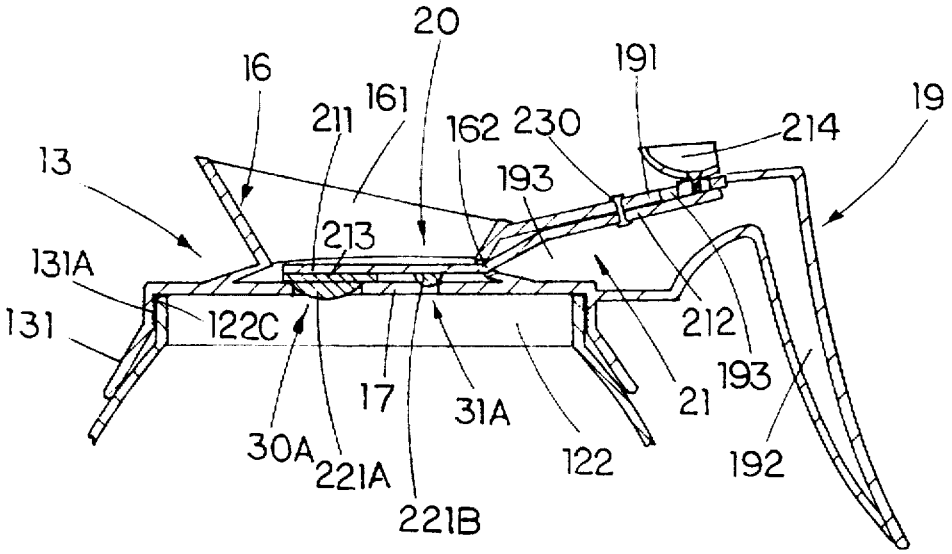
FIG. 3B is a partial sectional side view of the dual compartment beverage dispenser according to the above first preferred embodiment of the present invention.

Besides the cover wall 17, another essential feature of the beverage dispenser of the present invention distinct from the common coffee pot is that the beverage dispenser 1 further comprises a built-in shut off device 20. The shut off device 20 comprises a switching arm 21 having a horizontal front cap arm portion 211 and an inclined rear operating arm portion 212 extended rearwardly from the front cap arm portion 211 (as shown in FIG. 3B). The top spout 16 provides an operation slot 162 which has a width larger than a width of the switching arm 21. According to the present embodiment, the operation slot 162 is provided on the lip wall 161 at an intersection position of the lip wall 161 and the handle support bar 191. The cap arm portion 211 is extended through the operation slot 162 to locate on the cover wall 17 while the operating arm portion 212 is extended along the handle support bar 191. The switching arm 21 is incorporated with the top closure cap assembly 13 by pivotally connecting the operating arm portion 212 with the handle support bar 191 of the handle 19 by means of an axle pin 230, so that the cap arm portion 211 can thus be actuated to move between a first position and a second position to respectively overlap and shut off the first spout opening 30A and air hole 31A or the second spout opening 30B and air hole 31B on the cover wall 17 by switching the operating arm portion 212 to left or right An enlarged shutting head 213 is provided at a front end of the cap arm portion 211. The shutting head 213, which has a size larger than the size of the spout openings 30A and 30B, is adapted to be positioned between the first position for overlapping the first spout opening 30A and the second position for overlapping second spout opening 30B. An actuator head 214, which is exteriorly positioned on the handle support rod 191, is connected to a rear end of the operating arm portion 212, so that the thumb of the user's hand which grips on the grip handle 192 can rest on the actuator head 214 and switch the actuator head 214 to a left position so as to drive the cap arm portion 211 to the first position for shutting off the first spout opening 30A and the first air hole 31A. At this moment the beverage inside the second internal chamber 12B can thus be poured out through the second spout opening 30B. If the user's thumb switches the actuator head 214 to a right position, the cap arm portion 211 and the shutting head 213 are driven to the second position for shutting off the second spout opening 30B and the second air hole 31B, so that the beverage inside the first internal chamber 12A can thus be poured out through the first spout opening 30A.

Since the axle pin 230 is positioned as close as possible with the actuator head 214 according to the present invention, a small angular displacement of the actuator head 214 may drive the shutting head 213 to move for a wider angular displacement, so that the shutting head 213 can be driven to move between the first or the second positions for shutting off the first and second spout opening 30A and 30B by just slightly switching the actuator head 214 to the left or right by the user. Moreover, as show in FIG. 3B, the handle support rod 191 of the handle 19 further has an arm receiving chamber 193 extending rearwardly from the operation slot 162, and an actuator slot 194 provided thereon, so that the operating arm portion 212 can be hidden inside the receiving chamber 193 and connected with the actuator head 214 through the actuator slot 194.

Respective to the locations of the first and second spout openings 30A, 30B and the first and second air holes 31A, 31B, as shown in FIG. 3B, an opening sealing rubber 221A and a hole sealing rubber 221B are firmly attached to a bottom surface of the shutting head 213 and a bottom surface of a predetermined position of the cap arm portion 211 respectively for ensuring the shutting off of the first spout opening 30A and the first air hole 31A or the second spout opening 30B and the second air hole 31B in air tight sealing manner.

Accordingly, by controlling the left or right position of the actuator head 214 by the user's thumb, one of the spout openings 30A or 30B is shut off by the shutting head 213, so that the other of the spout openings 30A or 30B allows the beverage flows from the corresponding internal chamber 12A or 12B out to the spout 16 for delivering to the outside atmosphere.

As shown in FIGS. 5 to 7B, a second preferred embodiment of a dual compartment beverage dispenser of the present invention is illustrated. The beverage dispenser 6 also comprises a beverage container assembly 101, a top closure cap assembly 13 having a similar configuration of that of the above first preferred embodiment, and a shut off device 200.

Figure 5:
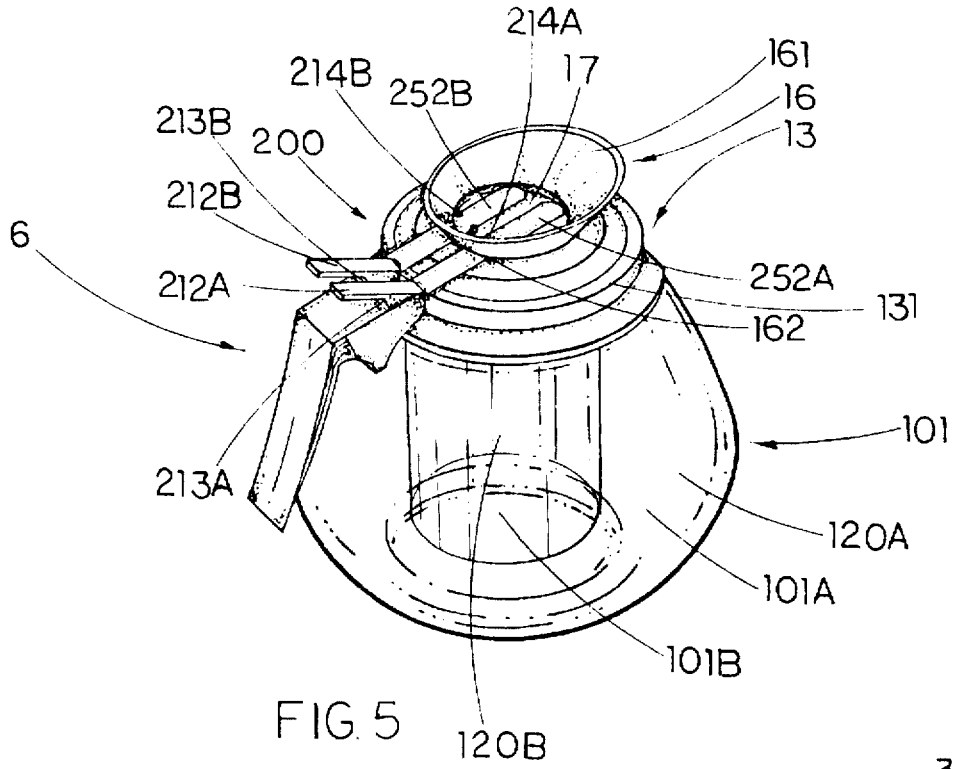
FIG. 5 is a perspective view of a dual compartment beverage dispenser according to a second preferred embodiment of the present invention.
Figure 6:
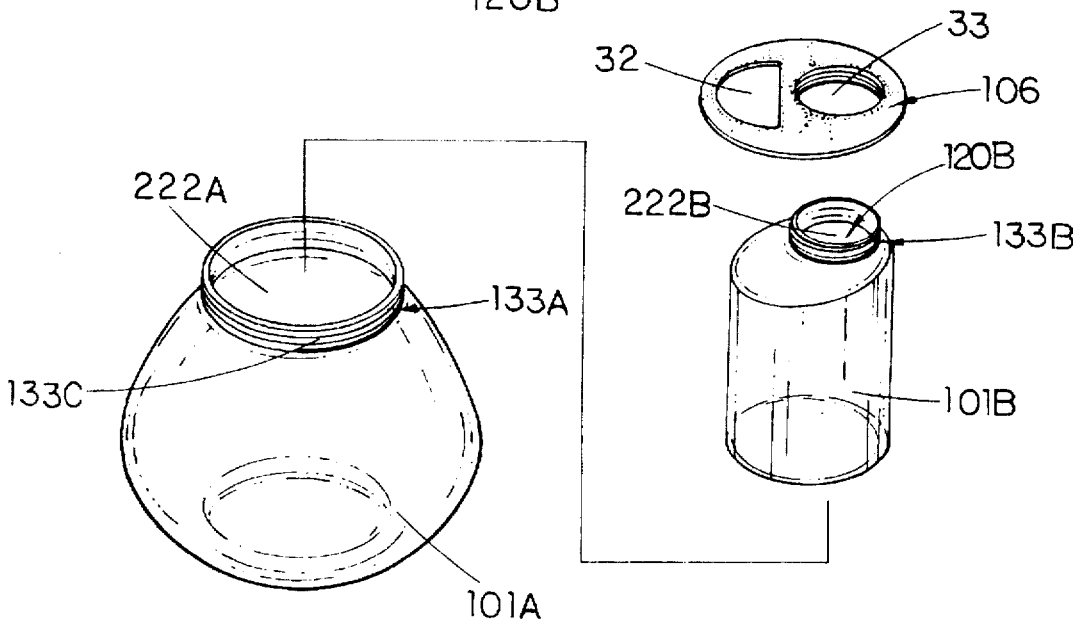
FIG. 6 is an exploded perspective view of a beverage container assembly of the dual compartment beverage dispenser according to the above second preferred embodiment of the present invention, showing the relationship between the first single chamber container, the second single chamber container and the sealing disc.

As shown in FIGS. 5 and 6, the beverage container assembly 101 comprises a first single chamber container 101A and a second single chamber container 101B, each of which has a top opening 222A and 222B thereon. The first single chamber container 101A is a larger body container having an identical configuration and shape of a conventional glass coffee pot container, which has a top securing neck 133A for connecting with the top closure cap assembly 13 by screwing thereto. The second single chamber container 101B is a slim barrel body having a dimension fitted through the top opening 222A of the first single chamber container 101A. The second single chamber container 101B has a ring edge 133B adapted for sealedly connected to a sealing disc 106.

The sealing disc 106, which has a same diameter as the top opening 222A of the first single chamber container 101A, is fittedly and firmly mounted on the top opening 222A of the top securing neck 133A of the first single chamber container 101A, so that the second single chamber container 101B can be disposed inside the first single chamber container 101A, as shown in FIG. 5, to form the beverage container assembly 101 and define a first internal chamber 120A between the walls of the first and second single chamber containers 101A, 101B and a second internal chamber 120B inside the second single chamber container 101B.

On the sealing disc 106, a first access opening 32 and a second access opening 33 are formed thereon, wherein the second access opening 33 is aligned with the top opening 133B of the second single chamber container 101B to form a flowing passage with second internal chamber 120B and the first access opening 32 is a semi-circular hole positioned right above the first internal chamber 120A for providing a flowing passage with the first internal chamber 120A.

Figure 7A:
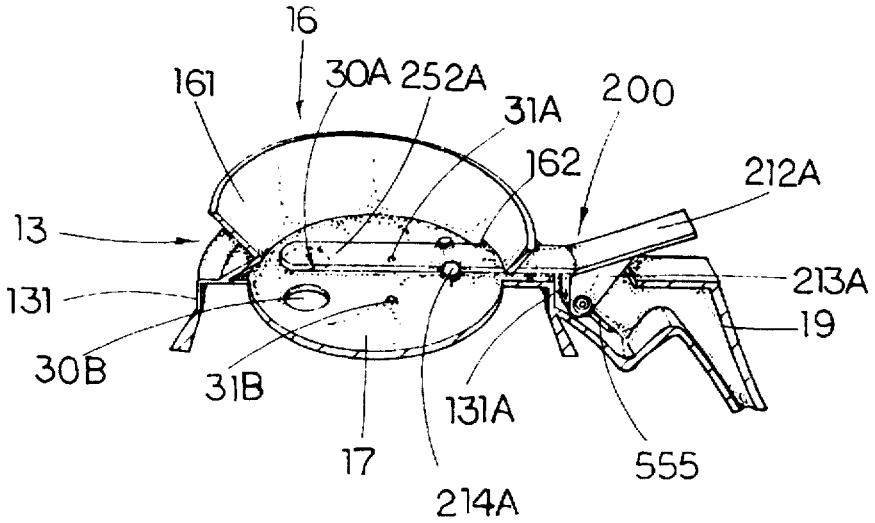
FIG. 7A is a partial sectional perspective view of the top closure cap assembly of the dual compartment beverage dispenser according to the above second preferred embodiment of the present invention, showing one of the sliding arms at a pull back releasing position.
Figure 4:
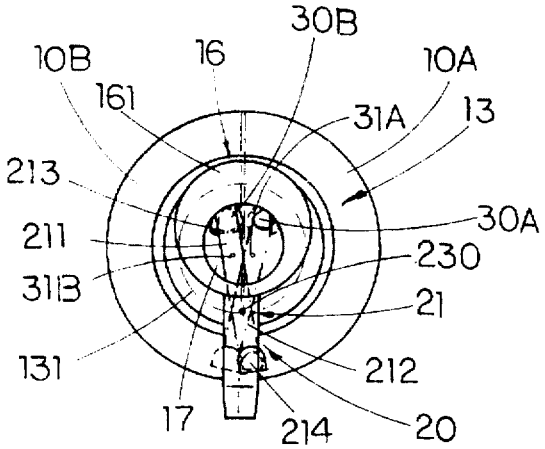
FIG. 4 is a top view of the dual compartment beverage dispenser according to the above first preferred embodiment of the present invention, showing the operation of the switching arm for shutting off the spout openings between the first and second positions.

The top closure cap assembly 13 also comprises a U-shaped bottom cover 131 having inner threaded portion 131A for screwing with an outer threaded portion 133C of the top securing neck 133A, as shown in FIGS. 6 and 7A, so as to connect the top closure cap assembly 13 with the beverage container assembly 101. The top closure cap assembly 13 further comprises a conical top spout 16 having a periphery lip wall 161 upwardly and inclinedly extended from the bottom cover 131, and a horizontal cover wall 17 integrally formed between the bottom cover 13 and the top spout 16 for covering both the access openings 32 and 33 of the first and second internal chambers 120A and 120B respectively, so as to provide an air tight concealing between the first single chamber container 101A, the second single chamber container 101B and the top closure cap assembly 13. A handle 19 is integrally extended from the bottom cover 131.

The cover wall 17 also provides a first and a second spout opening 30A and 30B and a first and a second air hole 31A and 31B, wherein the first spout opening 30A and the first air hole 31A are respectively formed in a front and a rear positions of a first half of the cover wall 17 positioned above the first access opening 32 of the first single chamber container 101A. The second spout opening 30B and the second air hole 31B are respectively formed in a front and a rear positions of a second half of the cover wall 17 positioned above the second access opening 33 of the second single chamber container 101B. Therefore, the beverages contained within the first and second internal chambers 120A and 120B can be selectively poured out through the first and second spout opening 30A and 30B.

Figure 7B:
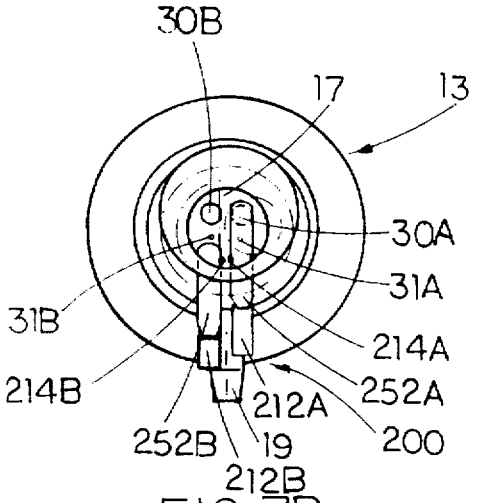
FIG. 7B is a top view of the dual compartment beverage dispenser according to the above second preferred embodiment of the present invention.

As shown in FIGS. 5, 7A and 7B, the shut off device 200 comprises a first and a second sliding arms 252A and 252B, in which the sliding arms 252A and 252B are mobilized to slide back. Each of the first and second sliding arms 252A and 252B has a front cap arm portion positioned on the cover wall 17 and a rear operating arm portion extending through an operation slot 162, which is provided on the lip wall 161 of the top spout 16, to the handle 19 for connecting with a thumb pressing element 212A, 212B which is supported by a spring activated revolving joint 213A, 213B mounted on the handle 19 along with a build in push-up spring 555, in which by releasing the thumb pressing element 212 A, 212B will firmly pressure the pressing element 212A, 212B back to the original position. A first and a second pair of guider protrusions 214A and 214B are provided on the cover wall 17 for holding the first and second sliding arms 252A and 252B in position respectively and for guiding the linear sliding motion of the first and second sliding arms 252A and 252B respectively. The sliding motion of each of the first and second sliding arms 252A and 252B is actuated by a downward pressing force applied to the respective thumb pressing element 212A or 212B. In normal shutting off condition, both the sliding arms 252A, 252B remain in their frontward position to respectively shut off the first spout opening 30A and the first air hole 31A and the second spout opening 30B and air hole 31B unless the user uses the thumb of his or her hand gripping with the handle 19 to selectively press on one of the thumb pressing elements 212A, 212B to drive the corresponding sliding arm 252A or 252B moving rearwards to a pull back releasing position for opening the respective spout opening 30A, 30B and air hole 31A, 31B, as shown in FIG. 7B.

Figure 8:
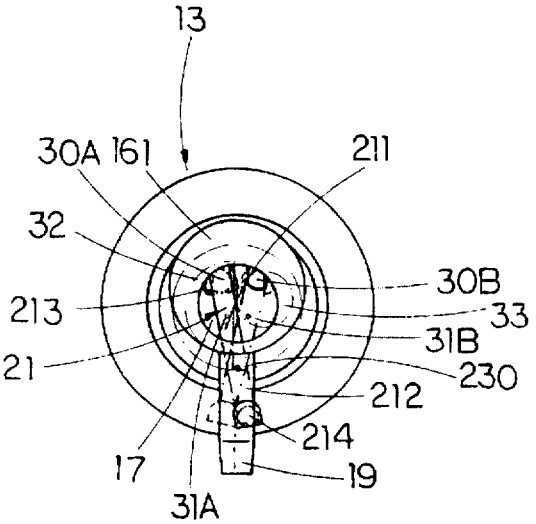
FIG. 8 is a top view of a dual compartment beverage dispenser according to a first alternative mode of the above first and second preferred embodiment of the present invention.
Figure 9:
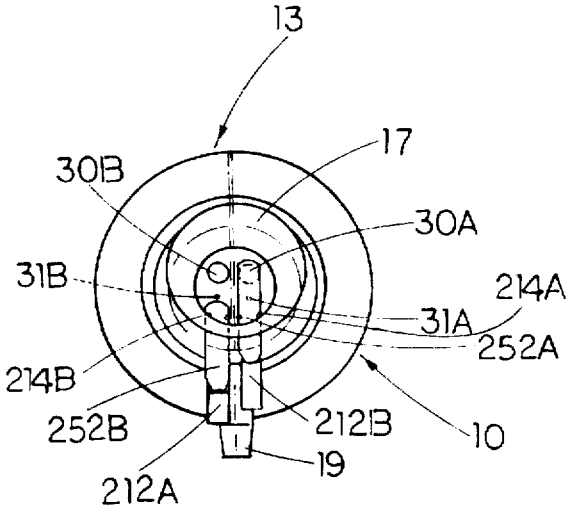
FIG. 9 is a top view of a dual compartment beverage dispenser according to a second alternative mode of the above first and second preferred embodiment of the present invention.

FIGS. 8 and 9 show two alternative modes of the first preferred embodiment and the second preferred embodiment respectively. As shown in FIG. 8, the top closure cap assembly 13 installed with the shut off device 20 disclosed in the first embodiment can be incorporated with the beverage container assembly 101 disclosed in the above second embodiment. However, as shown in FIG. 9, the top closure cap assembly 13 with the shut off device 200 described in the second embodiment can also be incorporated with the beverage container assembly 10 described in the above first embodiment.

I claim:

1. A dual compartment beverage dispenser, comprising:

a first single chamber container having a first internal chamber and a second single chamber container having a second internal chamber, wherein said first and second single chamber containers are combined to form a beverage container assembly which has a top securing neck having a first and a second access opening for said first and second internal chambers respectively;

a top closure cap assembly, which is secured to said top securing neck of said beverage container assembly in air tight manner to seal off said first and second single chamber containers, comprising a U-shaped bottom cover with an inner threaded portion for screwing with an outer threaded portion of said top securing neck so as to secure said top closure cap assembly with said beverage container assembly, a conical top spout having a periphery lip wall upwardly and inclinedly extended from said bottom cover, and a horizontal cover wall integrally formed between said bottom cover and said top spout for covering said first and second access openings of said first and second internal chambers of said first and second single chamber containers respectively, so as to provide an air tight concealing between said first single chamber container, said second single chamber container and said top closure cap assembly, in which said cover wall has a first and a second spout opening and a first and a second air hole, wherein said first spout opening and said first air hole are respectively formed in a front and a rear position of a first half of said cover wall above said first access opening of said first single chamber container, and that said second spout opening and said second air hole are respectively formed in a front and a rear position of a second half of said cover wall above said second access opening of said second single chamber container, said top closure cap assembly further comprising a L-shaped handle which is composed of a handle support bar integrally extended upwardly and inclinedly from an edge of said bottom cover and a grip handle integrally extended downwardly and perpendicularly from said handle support bar; and a shut off device which comprises a switching arm having a horizontal front cap arm portion and an inclined rear operating arm portion extended rearwardly from said front cap arm portion, said top spout providing an operation slot which has a width larger than a width of said switching arm and is formed on said lip wall at an intersection position of said lip wall and said handle support bar, said cap arm portion being extended through said operation slot to locate on said cover wall while said operating arm portion is extended along said handle support bar, in which said switching arm is incorporated with said top closure cap assembly by pivotally connecting said operating arm portion with said handle support bar of said handle by means of an axle pin, so that said cap arm portion is able to be actuated to move between a first position and a second position on said cover wall by switching said operating arm portion to left and right respectively, an enlarged shutting head being provided at a front end of said cap arm portion, wherein said cap arm portion and said shutting head which has a size slightly larger than said spout openings is adapted to be positioned between said first position, for overlapping and shutting off said first spout opening and said first air hole, and said second position, for overlapping and shutting off second spout opening and said second air hole, when said operating arm portion is driven to left and right alternatively.

2. A beverage dispenser, as recited in claim 1, in which a rear end of said operating arm portion of said switching arm further connects with an actuator head which is exteriorly positioned on said handle support rod.

3. A beverage dispenser, as recited in claim 2, in which said handle support rod of said handle further provides an arm receiving chamber extending rearwardly from said operation slot and an actuator slot thereon, so that said operating arm portion is received inside said receiving chamber and connected with said actuator head through said actuator slot.

4. A beverage dispenser, as recited in claim 1, in which, respective to the locations of said first and second spout openings and said first and second air holes, an opening sealing rubber and a hole sealing rubber are firmly attached to a bottom surface of said shutting head and a bottom surface of a predetermined position of said cap arm portion respectively for selectively shutting off said first and second spout openings and said first and second air holes in air tight sealing manner.

5. A beverage dispenser, as recited in claim 2, in which, respective to the locations of said first and second spout openings and said first and second air holes, an opening sealing rubber and a hole sealing rubber are firmly attached to a bottom surface of said shutting head and a bottom surface of a predetermined position of said cap arm portion respectively for selectively shutting off said first and second spout openings and said first and second air holes in air tight sealing manner.

6. A beverage dispenser, as recited in claim 3, in which, respective to the locations of said first and second spout openings and said first and second air holes, an opening sealing rubber and a hole sealing rubber are firmly attached to a bottom surface of said shutting head and a bottom surface of a predetermined position of said cap arm portion respectively for selectively shutting off said first and second spout openings and said first and second air holes in air tight sealing manner.

7. A beverage dispenser, as recited in claim 1, in which each of said first and second single chamber containers has an identical semi-circular cross section, on top of each of said first and second single chamber containers, a top neck portion being provided thereon, wherein a planar back wall is formed at a back side of each said first and said second single chamber container, so that said beverage container assembly is formed by colliding said two back walls of said first and second single chamber containers, in which said two top neck portions of said first and second single chamber containers are combined to form said top securing neck for securing with said top closure cap assembly.

8. A beverage dispenser, as recited in claim 2, in which each of said first and second single chamber containers has an identical semi-circular cross section, on top of each of said first and second single chamber containers, a top neck portion being provided thereon, wherein a planar back wall is formed at a back side of each said first and second single chamber container, so that said beverage container assembly is formed by colliding said two back walls of said first and second single chamber containers, in which said two top neck portions of said first and second single chamber containers are combined to form said top securing neck for securing with said top closure cap assembly.

9. A beverage dispenser, as recited in claim 3, in which each of said first and second single chamber containers has an identical semi-circular cross section, on top of each of said first and second single chamber containers, a top neck portion being provided thereon, wherein a planar back wall is formed at a back side of each said first and second single chamber container, so that said beverage container assembly is formed by colliding said two back walls of said first and second single chamber containers, in which said two top neck portions of said first and second single chamber containers are combined to form said top securing neck for securing with said top closure cap assembly.

10. A beverage dispenser, as recited in claim 4, in which each of said first and second single chamber containers has an identical semi-circular cross section, on top of each of said first and second single chamber containers, a top neck portion being provided thereon, wherein a planar back wall is formed at a back side of each said first and second single chamber container, so that said beverage container assembly is formed by colliding said two back walls of said first and second single chamber containers, in which said two top neck portions of said first and second single chamber containers are combined to form said top securing neck for securing with said top closure cap assembly.

11. A beverage dispenser, as recited in claim 5, in which each of said first and second single chamber containers has an identical semi-circular cross section, on top of each of said first and second single chamber containers, a top neck portion being provided thereon, wherein a planar back wall is formed at a back side of each said first and second single chamber container, so that said beverage container assembly is formed by colliding said two back walls of said first and second single chamber containers, in which said two top neck portions of said first and second single chamber containers are combined to form said top securing neck for securing with said top closure cap assembly.

12. A beverage dispenser, as recited in claim 7, in which a metal made base closure cap is firmly secured to a base portion constituted by two semi base portions of said first and second single chamber containers of said beverage container assembly for providing a secure holding of said two single chamber containers together.

13. A beverage dispenser, as recited in claim 9, in which a metal made base closure cap is firmly secured to a base portion constituted by two semi base portions of said first and second single chamber containers of said beverage container assembly for providing a secure holding of said two single chamber containers together.

14. A beverage dispenser, as recited in claim 11, in which a metal made base closure cap is firmly secured to a base portion constituted by two semi base portions of said first and second single chamber containers of said beverage container assembly for providing a secure holding of said two single chamber containers together.

15. A dual compartment beverage dispenser, comprising a first single chamber container having a first internal chamber and a second single chamber container having a second internal chamber, wherein said first and second single chamber containers are combined to form a beverage container assembly which has a top securing neck having a first and a second top opening for said first and second internal chambers respectively;

a top closure cap assembly, which is secured to said top securing neck of said beverage container assembly in air tight manner to seal off said first and second single chamber containers, comprising a U-shaped bottom cover with an inner threaded portion for screwing with an outer threaded portion of said top securing neck so as to connect said top closure cap assembly with said beverage container assembly, a conical top spout having a periphery lip wall upwardly and inclinedly extended from said bottom cover, and a horizontal cover wall integrally formed between said bottom cover and said top spout for covering said first and second top openings of said first and second internal chambers of said first and second single chamber containers respectively, so as to provide an air tight concealing between said first single chamber container, said second single chamber container and said top closure cap assembly, in which said cover wall has a first and a second spout opening and a first and a second air hole, wherein said first spout opening and said first air hole are respectively formed in a front and a rear position of a first half of said cover wall above said first top opening of said first single chamber container, and that said second spout opening and said second air hole are respectively formed in a front and a rear position of a second half of said cover wall above said second top opening of said second single chamber container, said top closure cap assembly further comprising a handle; and a shut off device comprising a first and a second sliding arms, in which said first and second sliding arms are able to be mobilized to slide back, each of said first and second sliding arms having a front cap arm portion positioned on said cover wall and a rear operating arm portion extending through an operation slot, which is provided on said top closure cap assembly, to said handle for connecting with a thumb pressing element which is supported by a revolving joint mounted on said handle, a first and a second pair of guider protrusions being provided on said cover wall for holding said first and second sliding arms in position respectively and for guiding a linear backward sliding motion of each of said first and second sliding arms respectively, wherein said backward sliding motion of each of said first and second sliding arms is actuated by a downward pressing force applied to said respective thumb pressing element.

16. A beverage dispenser, as recited in claim 15, said first single chamber container is a large body container having said top securing neck, said second single chamber container being a barrel body having a dimension fitted through said first top opening of said first single chamber container, said second single chamber container having a ring edge adapted for sealedly connecting with a sealing disc, in which said sealing disc, which has a same diameter as said top opening of said first single chamber container, is fittedly and firmly mounted on said first top opening of said top securing neck of said first single chamber container, so that said second single chamber container is disposed within said first single chamber container to form said beverage container assembly, and that said first internal chamber is defined between a wall of said first single chamber container and a wall of said second single chamber container, said second internal chamber being defined inside said second single chamber container, wherein said first top opening and said second access opening are provided on said sealing disc, said second top opening being aligned with said second top opening of said second internal chamber of said second single chamber container, and said first top opening being positioned right above said first top opening of said first internal chamber of said first single chamber container.

17. A beverage dispenser, as recited in claim 15, in which each of said first and second single chamber containers has an identical semi-circular cross section, on top of each of said first and second single chamber containers, a top neck portion being provided thereon, wherein a planar back wall is formed at a back side of each said first and said second single chamber container, so that said beverage container assembly is formed by colliding said two back walls of said first and second single chamber containers, in which said two top neck portions of said first and second single chamber containers are combined to form said top securing neck for securing with said top closure cap assembly.

18. A beverage dispenser, as recited in claim 17, in which a metal made base closure cap is firmly secured to a base portion constituted by two semi base portions of said first and second single chamber containers of said beverage container assembly for providing a secure holding of said two single chamber containers together.

* * * * *